US011066134B1

(12) United States Patent
Dial, III

(10) Patent No.: US 11,066,134 B1
(45) **Date of Patent: *Jul. 20, 2021**

(54) INFLATABLE RIDE-ON WATER TOY

(71) Applicant: Walter David Dial, III, Rogers, AR (US)

(72) Inventor: Walter David Dial, III, Rogers, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/858,308

(22) Filed: Apr. 24, 2020

Related U.S. Application Data

(63) Continuation of application No. 14/988,325, filed on Jan. 5, 2016, now Pat. No. 10,633,061.

(51) Int. Cl.

| | |
|---|---|
| ***B63B 34/50*** | (2020.01) |
| *B63B 21/20* | (2006.01) |
| *A63G 17/00* | (2006.01) |
| *A63G 31/12* | (2006.01) |
| *A63B 69/04* | (2006.01) |

(52) U.S. Cl.
CPC ..... *B63B 34/50* (2020.02); *A63B 69/04* (2013.01); *A63B 2225/605* (2013.01); *A63G 17/00* (2013.01); *A63G 31/12* (2013.01); *B63B 21/20* (2013.01)

(58) Field of Classification Search
CPC ..... A63G 31/12; A63G 19/00; A63G 13/066; B63C 2009/042; A63H 23/10; A63H 3/06; B63B 7/08; B63B 7/082; B63B 7/085; B63B 35/74; B63B 35/76; B63B 35/78; B63B 34/50
USPC ..... D21/808, 417, 473
See application file for complete search history.

(56) References Cited

U.S. PATENT DOCUMENTS

| | | | | |
|---|---|---|---|---|
| 1,851,768 | A | 3/1932 | Hubbell | |
| 2,404,729 | A | 7/1946 | Hurt | |
| 4,718,661 | A | 1/1988 | Wolfe | |
| 5,507,674 | A | 4/1996 | Yeung | |
| 6,053,790 | A * | 4/2000 | Langford | B63B 34/50 441/129 |
| 6,164,237 | A | 12/2000 | Coryell et al. | |
| 7,421,963 | B1 * | 9/2008 | Victor | B63C 1/00 114/45 |
| 8,187,047 | B1 | 5/2012 | Brooks | |
| 9,364,699 | B2 | 6/2016 | Gordon | |
| 9,578,966 | B2 * | 2/2017 | Paoletti | A47C 3/16 |
| 2005/0233676 | A1 | 10/2005 | Bohart | |
| 2006/0252601 | A1 | 11/2006 | Baum | |

OTHER PUBLICATIONS

INTEX, My Baby Float, Summer 2013 Catalog, Copyright 2012 (3 pages).

* cited by examiner

*Primary Examiner* — Andrew Polay
(74) *Attorney, Agent, or Firm* — McAfee & Taft

(57) ABSTRACT

An inflatable ride-on water toy comprising a stylized body that is connected to a separately inflated safety ring using a variety of configurations.

22 Claims, 7 Drawing Sheets

INFLATABLE RIDE-ON WATER TOY

CROSS REFERENCE TO RELATED APPLICATION

This application is a continuation of U.S. Non-Provisional application Ser. No. 14/988,325 filed on Jan. 5, 2016, now allowed, which is incorporated by reference.

BACKGROUND OF THE INVENTION

The disclosed invention is an inflatable ride-on water toy. There are many shapes and sizes of inflatable ride-on water toys available on the market today. One of the most widely used designs for inflatable ride-on water toys is a one-piece body with shapes ranging from stylized horses, animals, or fictional characters to amorphous shapes. Many of these commercially available one-piece designs have large circular flotation areas designed to maximize the overall stability of the ride-on device. With these designs, the user has a platform on which to balance and ride the inflatable animal shape. The user adjusts the stability of the platform by inflating or deflating the toy. U.S. Pat. No. 2,404,729 discloses an inflatable ride-on water toy having a one-piece structure wherein four balloon legs serve to stabilize the toy so as to make the toy suitable for riding in the water. U.S. Pat. No. 4,718,661 discloses a one-piece ride-on water toy having handles that stabilize the user. U.S. Pat. No. 1,851,768 discloses a one-piece ride-on water toy shaped like a swan wherein two pontoons serve to stabilize the toy. There are other unitary designs that do not have concentric stabilizing structures but these designs are difficult to master in the water. U.S. Pub. No. 2005/0233676 AI discloses an animal-like inflatable toy figure wherein the belly of the animal is designed to bounce and rock on the ground.

One-piece designs are largely chosen because they are easier to manufacture on a commercial scale and have fewer parts to assemble by the customer. There are drawbacks to a one-piece design. First, the main adjustable feature is the amount of air and inflation pressure, so users are limited as to the range of adjustments that can be made to alter stability of the unit. Second, one-piece designs limit the safety options. As users ride the toy in the water they risk injuring themselves on nearby edges when falling off the toy. The present disclosure serves to address the foregoing problems.

BRIEF SUMMARY OF THE INVENTION

Disclosed is a multi-piece inflatable ride-on water toy wherein a stylized body is designed for maximum range of activity is connected via tethers to a separately inflated safety ring that protects a rider from injury. The invention comprises a stylized body, which accommodates a rider and simulates the motion of a bucking bull or wild horse. The stylized body is inflated using one or more air inlet ports and includes one or more handles for the user to grasp. When riding the stylized body the invention simulates a bull riding competition.

A separate inflatable safety ring encircles the body of the toy and serves to protect the rider from injury. The safety ring is connected to the stylized body with a plurality of adjustable tethers. A user may preferentially adjust the tethers to select for a degree of stability in accordance with skill level. The tethers can be connected to the safety ring using several various mechanisms, all of which have the purpose of allowing quick detachment from the safety ring in the event the rider strikes one or more tethers.

Pull ropes are connected to a rigid motion bar oriented transverse to the stylized body. The pull ropes allow non-riding participants to create motion with the goal of unseating the rider. These and other advantages will become apparent from the following detailed description which, when viewed in light of the accompanying drawings, disclose the embodiment of the invention.

LISTING OF COMPONENTS

101—Safety Ring
103—Body
105—Tether
107—Tether Adjustment Buckle
108—Tether-Safety Ring Eyelet Anchor
109—Tether-Safety Ring Coupling
110—Tether-Body Anchor Plate
111—Air Inlet Port
113—Motion Bar
114—Motion Bar Eyelet Anchor
115—Motion Bar Sleeve
117—Pull Rope
118—Pull Rope Hook End
119—Mounting Handle
121—Body Handle
123—Ball Stud
125—Socket Anchor
127—Hook & Loop Closure

DETAILED DESCRIPTION OF THE INVENTION

First Preferred Embodiment

Figure 1:
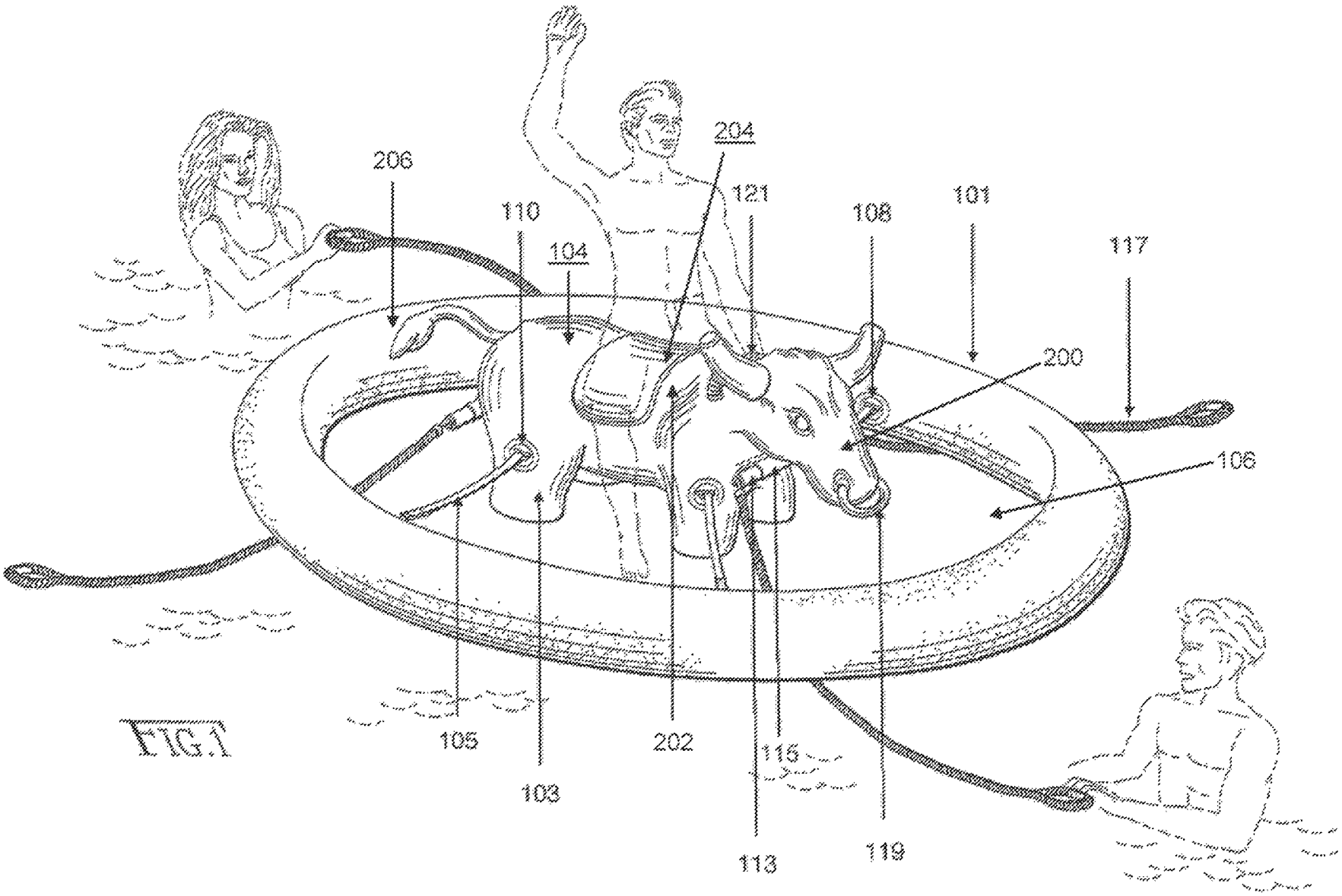
FIG. 1 is a perspective view of the inflatable ride-on water toy.
Figure 2:
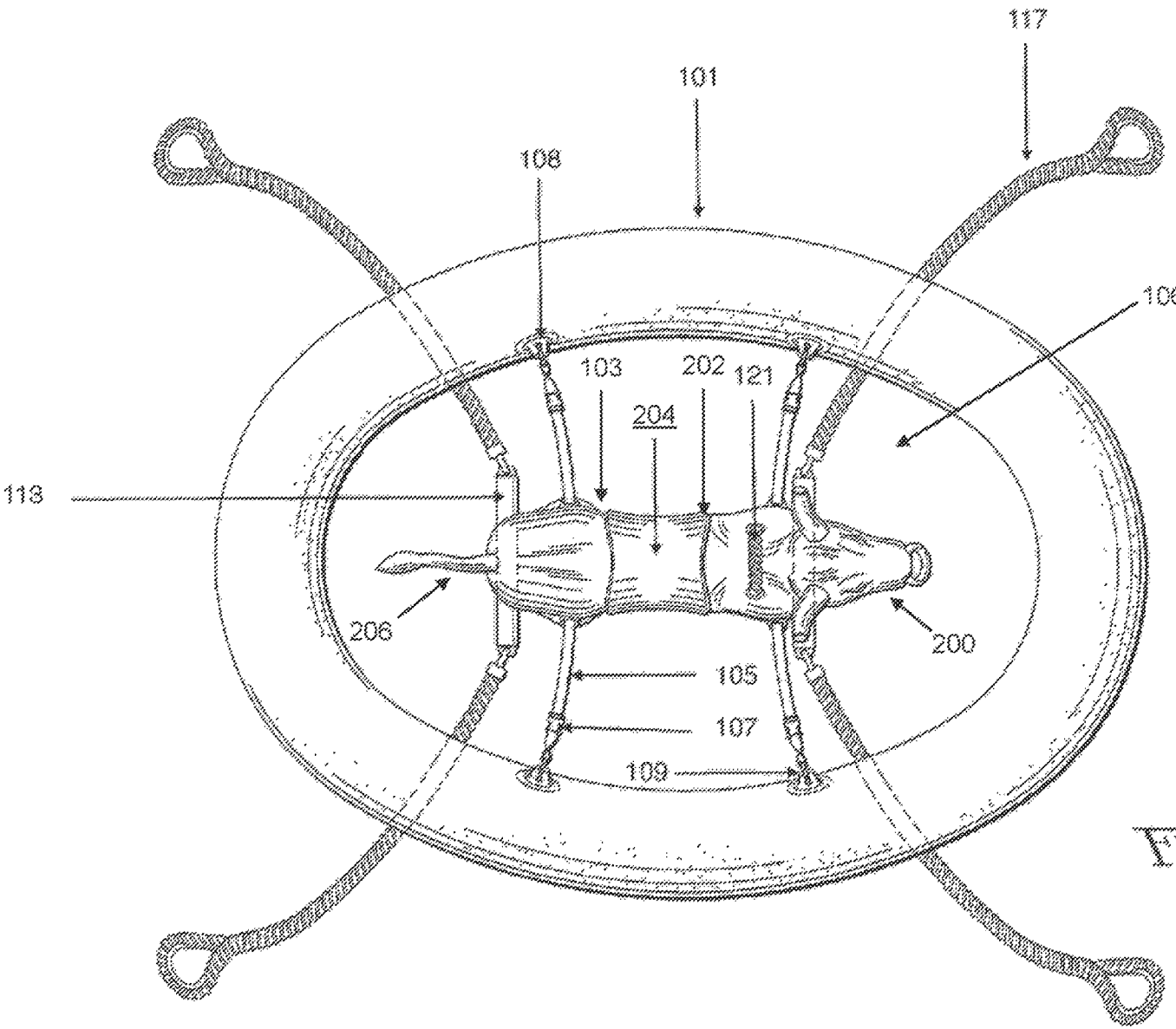
FIG. 2 is a top view of the inflatable ride-on water toy.
Figure 3:
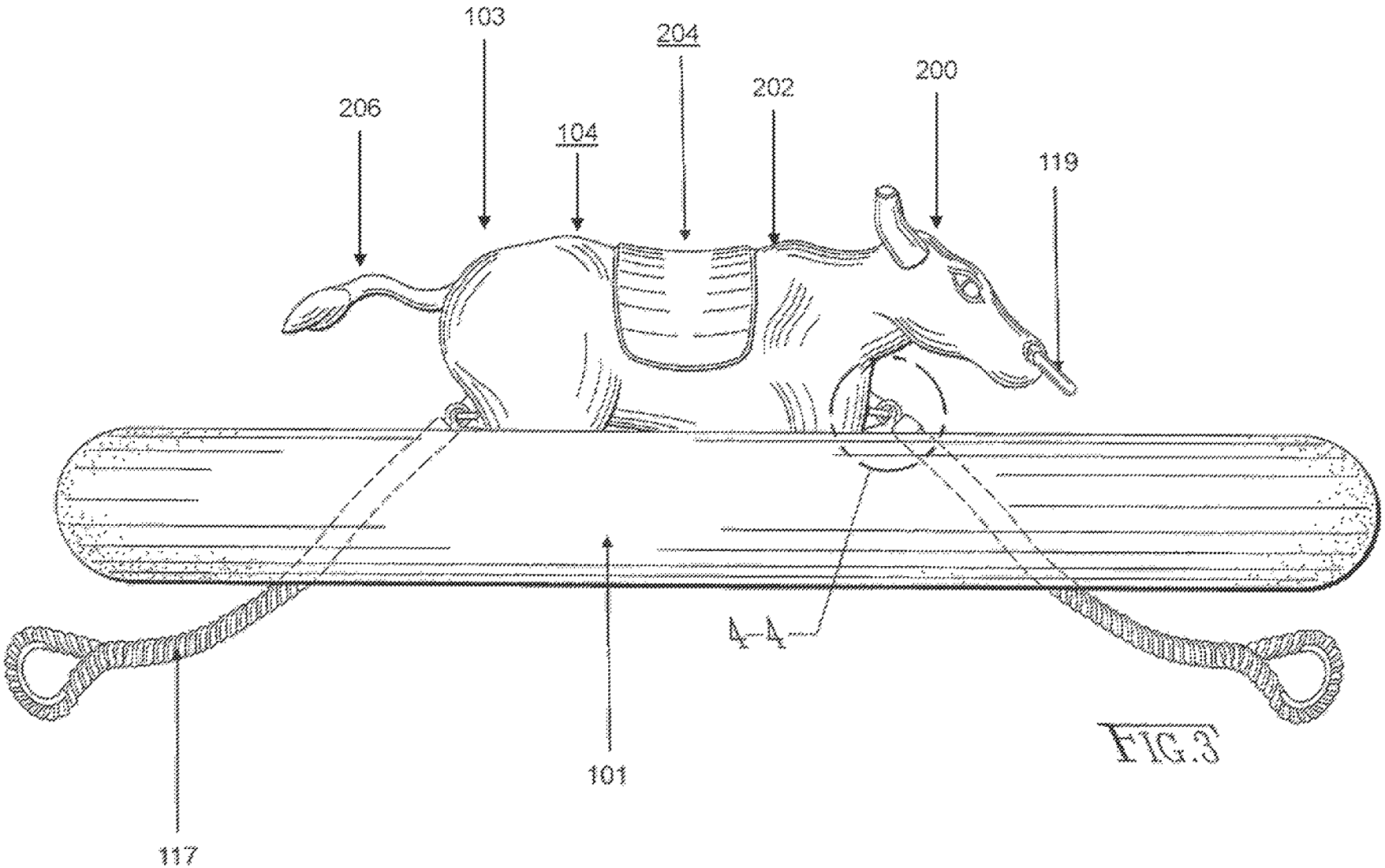
FIG. 3 is a side view of the inflatable ride-on water toy.
Figure 4:
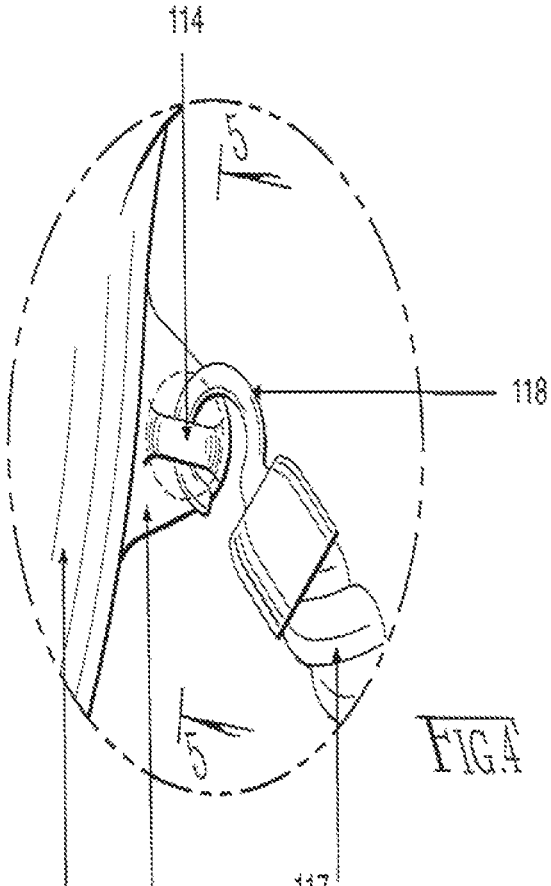
FIG. 4 is a detailed view of the pull rope hook end, motion bar eyelet anchor, and motion bar sleeve.
Figure 5:
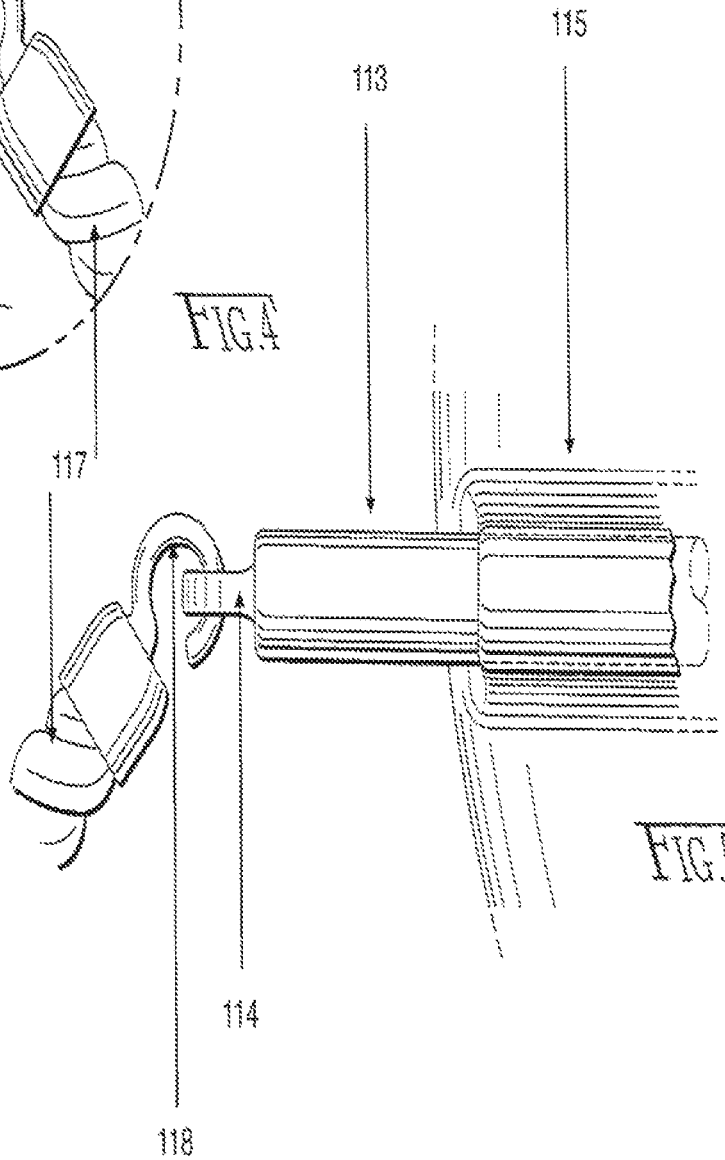
FIG. 5 is a detailed view of the pull rope hook end, motion bar eyelet anchor, motion bar, and motion bar sleeve.

In this first preferred embodiment the ride-on inflatable water toy comprises an inflatable safety ring 101 connected to an inflatable body 103 with a plurality of tethers 105. The safety ring 101 is oval in shape, although other shapes may be used. The safety ring 101 has at least one air inlet port 111 to allow for rapid inflation or deflation. The air inlet port 111 is preferably on the underside of the safety ring 101, although it may be placed anywhere. The safety ring 101 encircles the inflatable body 103 and is laterally connected to the inflatable body 103 via a plurality of tethers 105. The safety ring 101 has a plurality of connection points. As shown in FIGS. 1 and 2, an intermediate space 106 between the safety ring 101 and the inflatable body 103 exposes the water between the safety ring 101 and the inflatable body 103. The tethers 105 extend across the space 106 to connect the safety ring 101 to the inflatable body 103.

Figure 6:
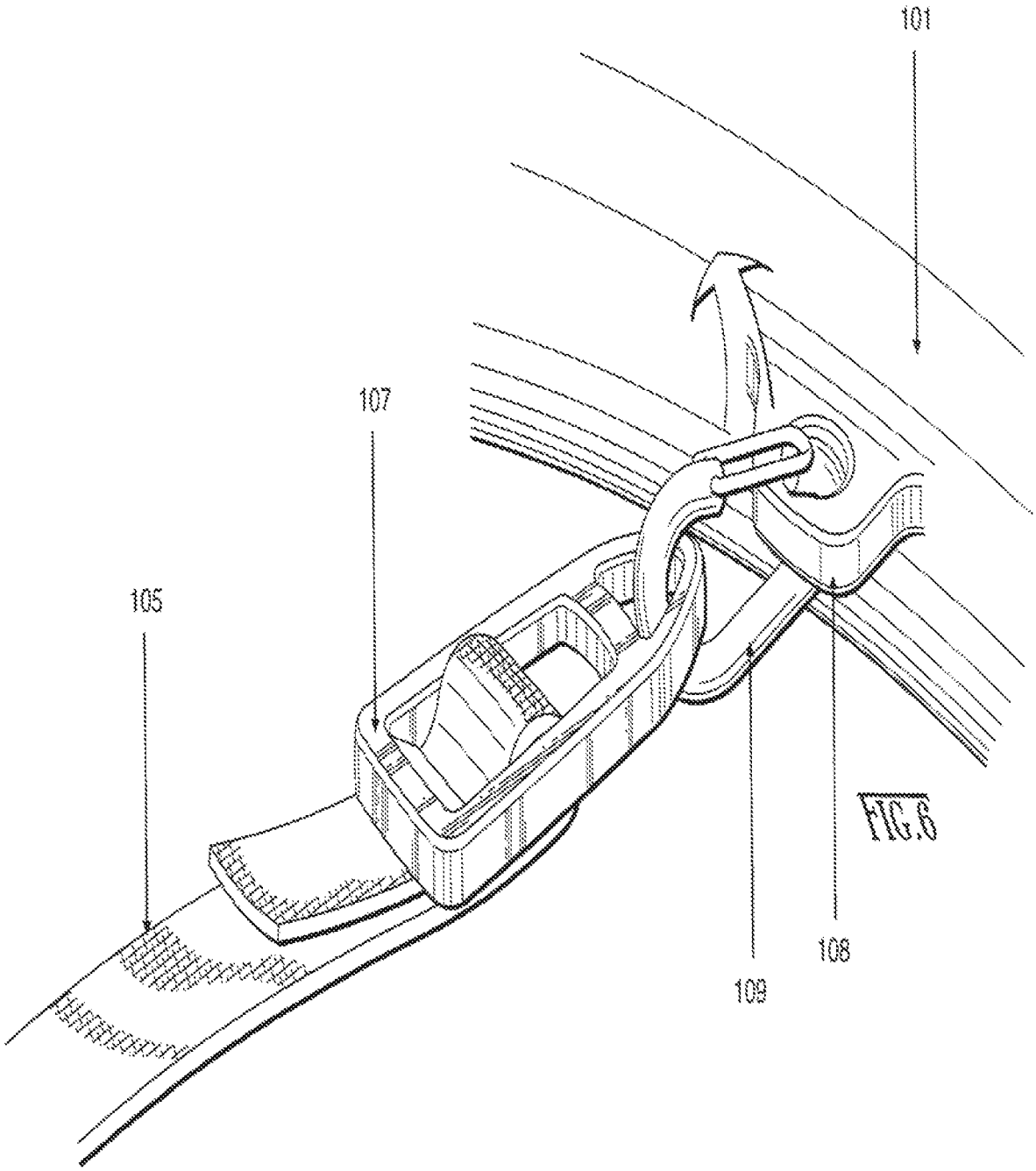
FIG. 6 is a detailed view of the tether adjustment buckle, tether-safety ring coupling, and tether-safety ring eyelet anchor.

The tethers 105 have two ends. In this first preferred embodiment, the first end is looped through a tether body anchor plate 110, which is fused to the inflatable body 103. At the second end, as shown in FIG. 6 the tethers 105 connect to the safety ring 101 via tether-safety ring couplings 109 and tether-safety ring eyelet anchors 108, which are connected to the safety ring 101. The tethers 105 may comprise any material having sufficient tensile strength.

In this first preferred embodiment, the tethers 105 are adjustable using tether adjustment buckles 107. The tethers 105 and the tether adjustment buckles 107 serve two purposes. First, they serve to prevent the inflatable body 103 from interfering with the safety ring 101. Second, they serve as the means by which the user can preferentially select the degree of stability of the inflatable body 103.

The tether-safety ring couplings 109 are designed such that if the rider falls off the body 103 and comes into contact with a tether 105 located in the space 106, the tether-safety ring coupling 109 may release from the safety ring 101 so as to minimize the risk of a rider from becoming entangled therein while in space 106.

The inflatable body 103 may be of any shape sufficient to support a rider on an upper surface 104 in the water although the current disclosure embodies a bull having a head 200, a back 202 with a concave seating surface 204 located on the upper surface 104 to support the rider (FIG. 1), and a tail 206. When the rider is seated on the seating surface 204, the rider's legs extend downward along opposing sides of the inflatable body 103 and toward the water through the space 106 (FIG. 1). The inflatable body 103 has an air inlet port 111 to allow for inflation and deflation. The air inlet port 111 is preferably on the underside of the inflatable body 103, although it may be placed anywhere on the body 103. The body 103 has a plurality of connection points.

The body handle 121 is attached to the inflatable body 103 in a manner similar to that shown in FIG. 2 and may be comprised of any material having sufficient strength such as plastic, metal, or rope. The body handle 121 serves to help stabilize the rider while the non-riding participants attempt to unseat the rider from the seating surface 204, as though the rider were simulating a bull riding competition.

The mounting handle 119 is preferably attached to the anterior of the inflatable body 103 substantially shown in FIG. 1. The mounting handle 119 allows a non-riding participant to stabilize the toy while the rider mounts the toy, whereby the non-riding participant holds the mounting handle 119 in order to prevent the body 103 from becoming unstable while the rider mounts the toy. The mounting handle 119 may be comprised of any material having sufficient durability such as wood, plastic, metal, or leather.

Two motion bar sleeves 115 are located near the underside of the inflatable body 103. As shown in FIGS. 1, 3, 4, and 5, the motion bar sleeves 115 run transverse to the inflatable body 103 and are preferably located on the anterior and posterior ends of the inflatable body 103. The motion bar sleeves 115 serve to connect the inflatable body 103 and the motion bars 113.

As shown in FIGS. 1-5, the motion bars 113 are oriented transverse to the inflatable body 103 and are inserted into the motion bar sleeves 115. The motion bars 113 are generally cylindrical in shape and are comprised of any material having sufficient durability, such as metal or plastic. The motion bars 113 have two ends with each having a motion bar eyelet anchor 114 so as to allow attachment of pull ropes 117.

The pull ropes 117 have a first and second end with the first end being loop shaped in nature and the second end having a pull rope hook end 118. The first looped end serves as the means by which non-riding participant(s) hold the pull ropes 117. The second end or pull rope hook end 118 serves as the means by which the pull ropes 117 attach to the motion bar 113 via the motion bar eyelet anchor 114. The pull ropes 117 are of sufficient durability. The motion bars 113 in conjunction with the pull ropes 117 serve to efficiently transfer energy to the inflatable body 103, thereby allowing non-riding participant(s) to create motion in the inflatable body 103 of the toy and unseat the rider.

Second Preferred Embodiment

Figure 7:
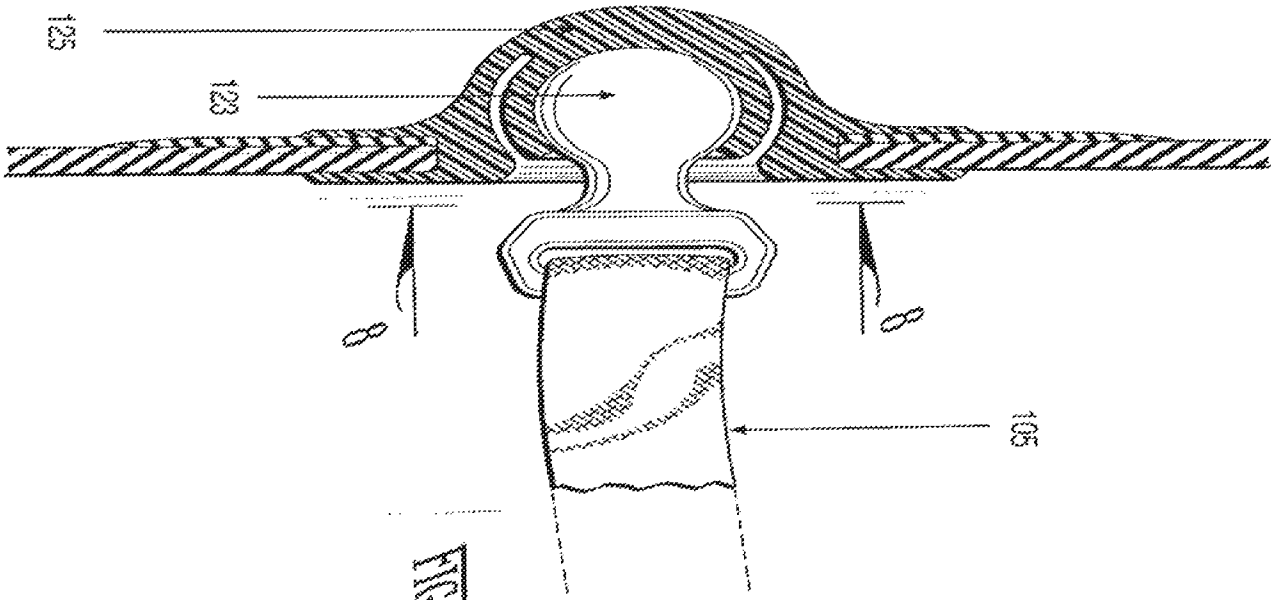
FIG. 7 is a detailed view of the ball stud and socket anchor.
Figure 8:
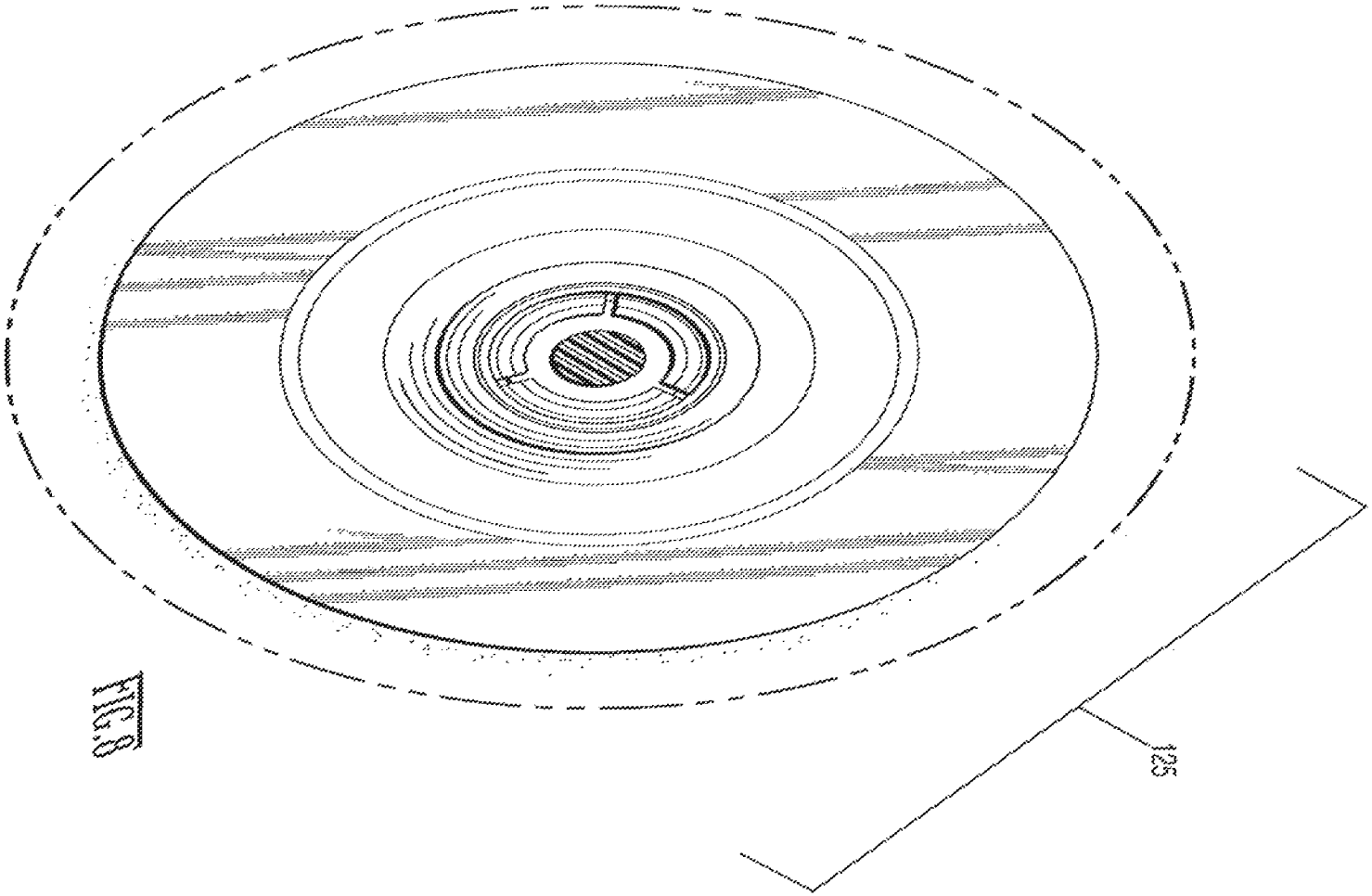
FIG. 8 is a frontal view of the socket anchor.

A second preferred embodiment of this inflatable ride-on water toy contains those elements set forth in the first preferred embodiment with the exception of the tether-safety ring coupling 109 and the tether-safety ring eyelet anchor 108. In this second preferred embodiment the tethers 105 are attached to the safety ring 101 via a ball stud 123 and a socket anchor 125, as shown in FIGS. 7, 8. As referenced in the first preferred embodiment, the tethers 105 are adjustable via tether adjustment buckles 107. In this second preferred embodiment, the ball stud and socket anchor 123, 125 are designed such that if during use the riding user falls off the body 103 and comes into contact with a tether 105, the ball stud 123 will break-away from the socket anchor 125 so as to prevent the rider from becoming entangled therein.

Third Preferred Embodiment

A third preferred embodiment of this inflatable ride-on water toy contains those elements set forth in the first preferred embodiment with the exception of the tether-safety ring coupling 109, the tether-safety ring eyelet anchor 108, the tether adjustment buckle 107, and the tether-body anchor plate 110. In this third preferred embodiment the body 103 and the safety ring 101 are connected using a plurality of tethers 105, with different tethers serving as corresponding elements to a hook and loop closure 127. By example, a first tether 105 is connected to and extends from the safety ring 101, and using a hook and loop closure system 127, such first tether 105 attaches to a second corresponding tether 105 that is mounted to and extends from the (stylized) body 103. When mated together, the first tether 105 and the second tether 105 have a corresponding hook and loop closure 127 and the union creates a unitary tether 105 that connects the body 103 to the safety ring 101. The distance between the safety ring 101 and the body 103 may be preferentially adjusted by changing the mating point at which corresponding tethers 105 would attach to each other using the hook and loop closure system 127.

What is claimed is:

1. An inflatable, floating, ride-on water toy comprising:

an inflatable body having a plurality of connection points and a seating surface;

an inflatable safety ring having a plurality of connection points, the inflatable safety ring encircles the inflatable body; and a plurality of tethers connecting the inflatable body and the inflatable safety ring to one another, each tether having a first end and a second end, wherein the seating surface is positioned above at least a portion of the inflatable safety ring.

2. The inflatable, floating, ride-on water toy of claim 1, wherein the length of the tethers is adjusted via a tether adjustment buckle.

3. The inflatable, floating, ride-on water toy of claim 1, wherein at least one handle is attached to the inflatable body.

4. The inflatable, floating, ride-on water toy of claim 1, wherein the tethers have elasticity.

5. The inflatable, floating, ride-on water toy of claim 1, wherein the seating surface of the inflatable body is on an upper surface of the inflatable body.

6. The inflatable, floating, ride-on water toy of claim 1, wherein the upper surface of the inflatable body is positioned above an upper surface of the inflatable safety ring.

7. The inflatable, floating, ride-on water toy of claim 1, wherein the inflatable body is shaped as an animal.

8. The inflatable, floating, ride-on water toy of claim 1, wherein the plurality of tethers includes a left tether positioned located rearward of the seating surface and a right tether located rearward of the seating surface.

9. An inflatable, floating, ride-on water toy comprising:

an inflatable body having a plurality of connection points and an upper surface;

at least one mounting handle attached to the inflatable body;

an inflatable safety ring having a plurality of connection points and an upper surface;

a plurality of tethers connecting the inflatable body and the inflatable safety ring to one another, each tether having a first end and a second end, wherein a plurality of anchor plates are affixed to the connection points of the inflatable body and connected to the first ends of the tethers, wherein a plurality of anchors are affixed to the connection points of the inflatable safety ring and the second ends of the tethers, wherein the second ends of the tethers have tether-safety ring couplings; and, wherein the upper surface of the inflatable body is positioned above a portion of the upper surface of the inflatable safety ring.

10. The inflatable, floating, ride-on water toy of claim 9, wherein the length of the tethers is adjusted via a tether adjustment buckle.

11. The inflatable, floating, ride-on water toy of claim 9, wherein the plurality of tethers includes a left tether located rearward of the seating surface and a right tether located rearward of the seating surface.

12. An inflatable, floating, ride-on water toy comprising:

an inflatable body configured to support a rider;

an inflatable safety ring, the inflatable safety ring encircles the inflatable body;

a seating surface on an upper surface of the inflatable body, said seating surface positioned above the inflatable safety ring, wherein said seating surface is configured such that a rider's legs extend downward along opposing sides of the inflatable body when seated on the seating surface; and, a plurality of tethers extending through an intermediate space to connect the inflatable body to the inflatable safety ring.

13. The inflatable, floating, ride-on water toy of claim 12, wherein the inflatable body is animal-shaped.

14. The inflatable, floating, ride-on water toy of claim 12, wherein the inflatable body includes at least one handle.

15. The inflatable, floating, ride-on water toy of claim 12, wherein the plurality of tethers includes a left tether located rearward of the seating surface and a right tether located rearward of the seating surface.

16. An inflatable, floating, ride-on water toy comprising:

an inflatable animal-shaped body including:

a head;

a back with a seating surface; and a tail; and an inflatable safety ring encircles the inflatable animal-shaped body;

a first tether connecting the inflatable animal-shaped body and the inflatable safety ring to one another at a first location rearward of the seating surface; and, a second tether connecting the inflatable animal-shaped body and the inflatable safety ring to one another at a second location rearward of the seating surface.

17. The inflatable, floating, ride-on water toy of claim 16, wherein the seating surface of the inflatable animal-shaped body is positioned above the inflatable safety ring.

18. The inflatable, floating, ride-on water toy of claim 16, wherein the inflatable animal-shaped body includes at least one handle located forward of the seating surface and rearward of the head.

19. The inflatable, floating, ride-on water toy of claim 16, wherein the inflatable body includes at least one handle.

20. An inflatable, floating, ride-on water toy comprising:

an inflatable body having a plurality of connection points and a seating surface;

at least one handle attached to the inflatable body;

an inflatable safety ring having a plurality of connection points, the inflatable safety ring encircles the inflatable body; and a plurality of tethers connecting the inflatable body and the inflatable safety ring to one another, each tether having a first end and a second end, wherein the seating surface is positioned above at least a portion of the inflatable safety ring.

21. An inflatable, floating, ride-on water toy comprising:

an inflatable body having a plurality of connection points and a seating surface, wherein the seating surface of the inflatable body is on an upper surface of the inflatable body;

an inflatable safety ring having a plurality of connection points, the inflatable safety ring encircles the inflatable body;

a plurality of tethers connecting the inflatable body and the inflatable safety ring to one another, each tether having a first end and a second end, wherein the seating surface is positioned above at least a portion of the inflatable safety ring; and, wherein the seating surface is positioned above an upper surface of the inflatable safety ring.

22. An inflatable, floating, ride-on water toy comprising:

an inflatable body having a plurality of connection points and a seating surface;

an inflatable safety ring having a plurality of connection points, the inflatable safety ring encircles the inflatable body and defines an annular gap which surrounds the inflatable body; and a plurality of tethers connecting the inflatable body and the inflatable safety ring to one another, each tether having a first end and a second end.

* * * * *